US006550467B2

(12) United States Patent
Gallops, Jr.

(10) Patent No.: US 6,550,467 B2
(45) Date of Patent: Apr. 22, 2003

(54) TRAVELING BOWSTRING VIBRATION DAMPENER

(75) Inventor: Henry M. Gallops, Jr., Gainesville, FL (US)

(73) Assignee: Bear Archery, LLC, Gainesville, FL (US)

( * ) Notice: Subject to any disclaimer, the term of this patent is extended or adjusted under 35 U.S.C. 154(b) by 0 days.

(21) Appl. No.: 09/963,293

(22) Filed: Sep. 26, 2001

(65) Prior Publication Data

US 2003/0056779 A1 Mar. 27, 2003

(51) Int. Cl.[7] ..... F41B 5/10
(52) U.S. Cl. ..... 124/25.6; 124/86
(58) Field of Search ..... 124/25.6, 86, 88, 124/92

(56) References Cited

U.S. PATENT DOCUMENTS

| | | | | |
|---|---|---|---|---|
| 4,061,125 A | | 12/1977 | Trotter | |
| 4,440,143 A | | 4/1984 | Nishioka | |
| 4,461,267 A | | 7/1984 | Simonds et al. | |
| 4,542,732 A | | 9/1985 | Troncoso | |
| 4,628,892 A | | 12/1986 | Windedahl et al. | |
| 5,452,704 A | | 9/1995 | Winebarger | |
| 5,651,355 A | | 7/1997 | Gallops | |
| 5,718,213 A | | 2/1998 | Gallops | |
| 5,720,269 A | | 2/1998 | Saunders | |
| 6,152,124 A | * | 11/2000 | Gallops | 124/25.6 |
| 6,425,385 B1 | * | 7/2002 | Gallops | 124/25.6 |

* cited by examiner

*Primary Examiner*—John A. Ricci
(74) *Attorney, Agent, or Firm*—Milton Wolson

(57) ABSTRACT

A traveling bowstring vibration dampener for use in a compound bow is moveable in response to the draw and release of the bowstring.

24 Claims, 11 Drawing Sheets

TRAVELING BOWSTRING VIBRATION DAMPENER

STATEMENTS AS TO RIGHTS TO INVENTION MADE UNDER FEDERALLY SPONSORED RESEARCH AND DEVELOPMENT

The invention disclosed and claimed herein was not made under a federally sponsored research and development program.

CROSS-REFERENCE TO RELATED APPLICATIONS

There are no related applications.

BACKGROUND OF THE INVENTION

1. Field of the Invention

This invention relates to archery bows and, in particular, to dampening the amount of vibration or oscillation of a bowstring after it is released.

Various disadvantages are associated with the vibrations in archery bows that are produced when the bow is shot including the undesirable sound that is generated by the vibration of the bow when it is shot.

Because such sound travels faster than the arrow being shot, the sound may alert the target game and lessen the likelihood of a successful shot. Another disadvantage of bow vibration is that it may make the bow more difficult to grasp and thereby reduce the accuracy of the archer.

One of the factors that contribute to bow vibration is the vibration or oscillation of the bowstring after it is shot. The terms bowstring oscillation and bowstring vibration are used interchangeably herein. The present invention is directed to dampening or diminishing such bowstring oscillation.

2. Description of the Prior Art

Prior art which relates to the present invention, includes the following patents:

U.S. Pat. No. 4,542,732 to Troncosa discloses a cable guard assembly comprising a cable guide having spaced cable-receiving side grooves which are slideable on a cable guard arm.

U.S. Pat. No. 4,628,892 to Windedahl et al discloses a silencer for reducing the noise made by an archery bow when an arrow is shot. An elastic member having one end attached to the limb is stretched to its full length when the bow string is drawn and is returned to the relaxed length when the bowstring returns to its brace position.

U.S. Pat. No. 5,452,704 to Winebarger discloses a combination cable guard and vibration dampener whereby the sliding movement of a cable retaining means on a cable rod causes a spring member having cushioning material therein to converge upon and embrace the bowstring after the shot. The patent recites that this device causes bowstring vibration and the attendant noise to immediately cease.

U.S. Pat. No. 5,595,168 to Martin discloses a damping apparatus formed of a semi-solid substance which is located in the handle of the archery bow. This patent notes that a wide range of cable guards and cable guard slider have been developed to reduce noise.

U.S. Pat. No. 5,651,355 to Gallops, Jr. discloses a cable guard assembly comprising a cable guide having spaced cable-receiving grooves which is pivotally mounted on a support arm.

U.S. Pat. No. 5,718,213 to Gallops, Jr. et. al. discloses a swing arm cable guard assembly comprising a cable guide, having spaced cable-receiving side grooves, which is pivotally mounted on a swing arm and the swing arm is pivotally mounted on a support arm.

U.S. Pat. No. 5,720,269 to Saunders discloses a cushion member of sound dampening material in physical contact with the bowstring. When the bowstring is drawn and then released the vibration of the bowstring is dampened by compression of the cushion member and by the compressed cells of the cushion member clamping the bowstring. The cushion member does not itself move because it its mounted on a stationary rod attached to the cable guard.

SUMMARY OF THE INVENTION

A bowstring vibration dampener for use in a compound bow is attached to a traveling cable saver. The cable saver is caused to travel when cables within the cable saver are moved by the draw and release of the bowstring.

The vibration dampener abuts the bowstring and applies pressure to the bowstring when the bowstring is in the brace position. When the bowstring is drawn rearward, the cables move rearward causing the cable saver and the vibration dampener to travel rearward. When the bowstring is released and travels forward, the cables move forward causing the cable saver and vibration dampener to travel forward to their original or brace position. As the vibration dampener and the bowstring return to their original position, the vibration dampener contacts and cushions the bowstring to dampen the bowstring oscillation. Both the bowstring and the vibration dampener, whose movement is controlled by the bowstring travel, are in motion when the vibration dampener is in contact and cushions the bowstring. The dual motion of the bowstring and vibration dampener enhances the effectiveness of the vibration dampener to cushion and dampen the bowstring vibration as the bowstring returns to its brace position.

Two embodiments of the bowstring vibration dampener are disclosed. In a first embodiment, the cable saver having the vibration dampener mounted thereon is pivotally connected to a swing arm cable guard assembly. In the second embodiment, the cable saver having the vibration dampener mounted thereon slides on a support arm. These embodiments are presented for illustration purposes only and should not be construed as limiting the scope of the present invention.

It is therefore an object of the present invention to provide a traveling bowstring vibration dampener for use in a compound bow.

It is a further object to provide a traveling bowstring vibration dampener for use in a compound bow in which the travel of the bowstring vibration dampener is controlled by movement of the cables within the cable savers.

It is a still further object to provide a traveling bowstring vibration dampener for use in a compound bow in which both the bowstring and vibration dampener are in motion when the vibration dampener contacts and cushions the bowstring.

Other objects and attendant advantages of this invention will be readily appreciated as the same becomes more clearly understood by references to the following detailed description when considered in connection with the accompanying drawings in which like reference numerals designate like parts throughout the figures thereof.

BRIEF DESCRIPTION OF THE DRAWINGS

For a fuller understanding of the nature and objects and the invention, reference should be had to the following detailed description taken in connection with the accompanying drawing forming a part of this specification and in which similar numerals or references indicate corresponding parts in all the figures of the drawing, and in which.

DETAILED DESCRIPTION OF THE PREFERRED EMBODIMENT

Figure 1:
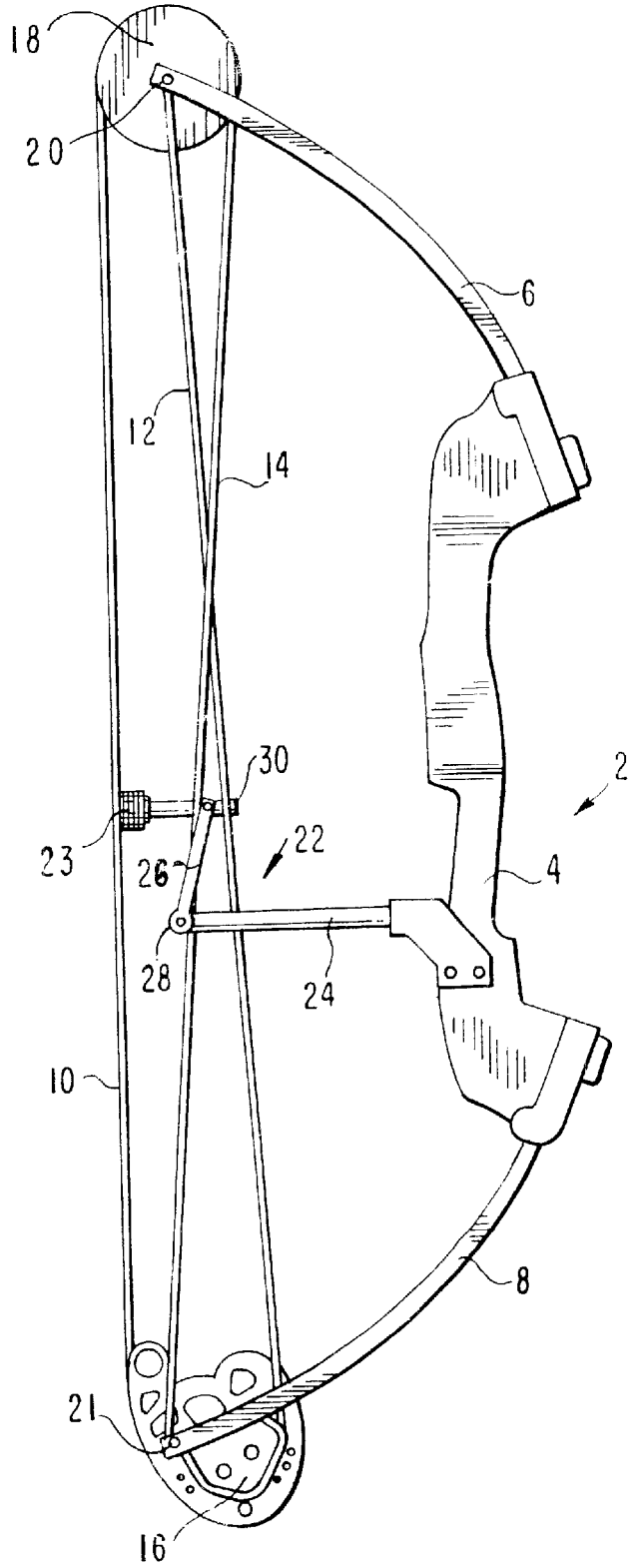
FIG. 1 is a right side elevational view of a compound archery bow which includes a first embodiment of the present invention.
Figure 2:
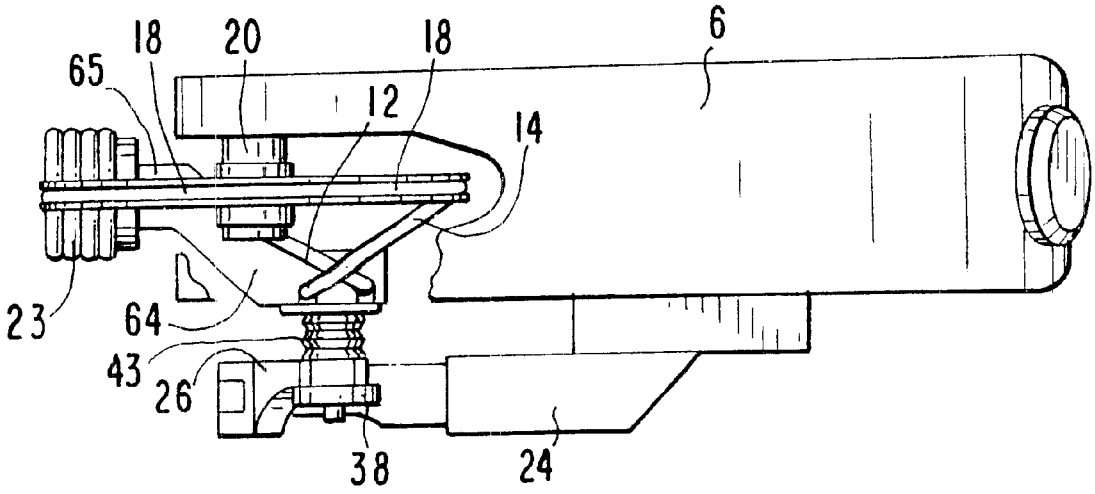
FIG. 2 is a cutaway top plan view of the first embodiment of the present invention wherein the bowstring is in the brace position.

With respect to the first embodiment of the bowstring vibration dampener of the present invention, there is shown in FIGS. 1 and 2 a compound archery bow 2 in the brace position. The illustrated compound bow 2 is of the type disclosed in U.S. Pat. No. 5,368,006 but it should be understood that the present invention is not limited to this type of compound bow. Compound archery bow 2 comprises a bow handle 4 attached to bow limbs 6 and 8 in known manner. A bowstring 10 and cables 12 and 14 are shown in their position relative to each other and to the handle 4 when the bowstring 10 is in the brace position. Cable 12 is referred to as an anchor cable and cable 14 is referred to as a secondary cable in U.S. Pat. No. 5,368,006.

The bowstring 10 and cable 14 are connected at one end to an eccentric cam 16 mounted on axle 21 carried by limb 8 At the other end, bowstring 10 and cable 14 extend over a pulley 18 mounted on axle 20 carried by limb 6. Cable 12 is connected at one end to eccentric cam 16 and at the other end to axle 20 carried by limb 6. It is necessary to provide a space between bowstring 10 and cables 12 and 14 to enable passage of an arrow therebetween and for this purpose a cable guard assembly 22 is provided. The cable guard assembly is generally of the type disclosed in U.S. Pat. No. 5,718,213 to Gallops, Jr.

Figures 5, 5A:
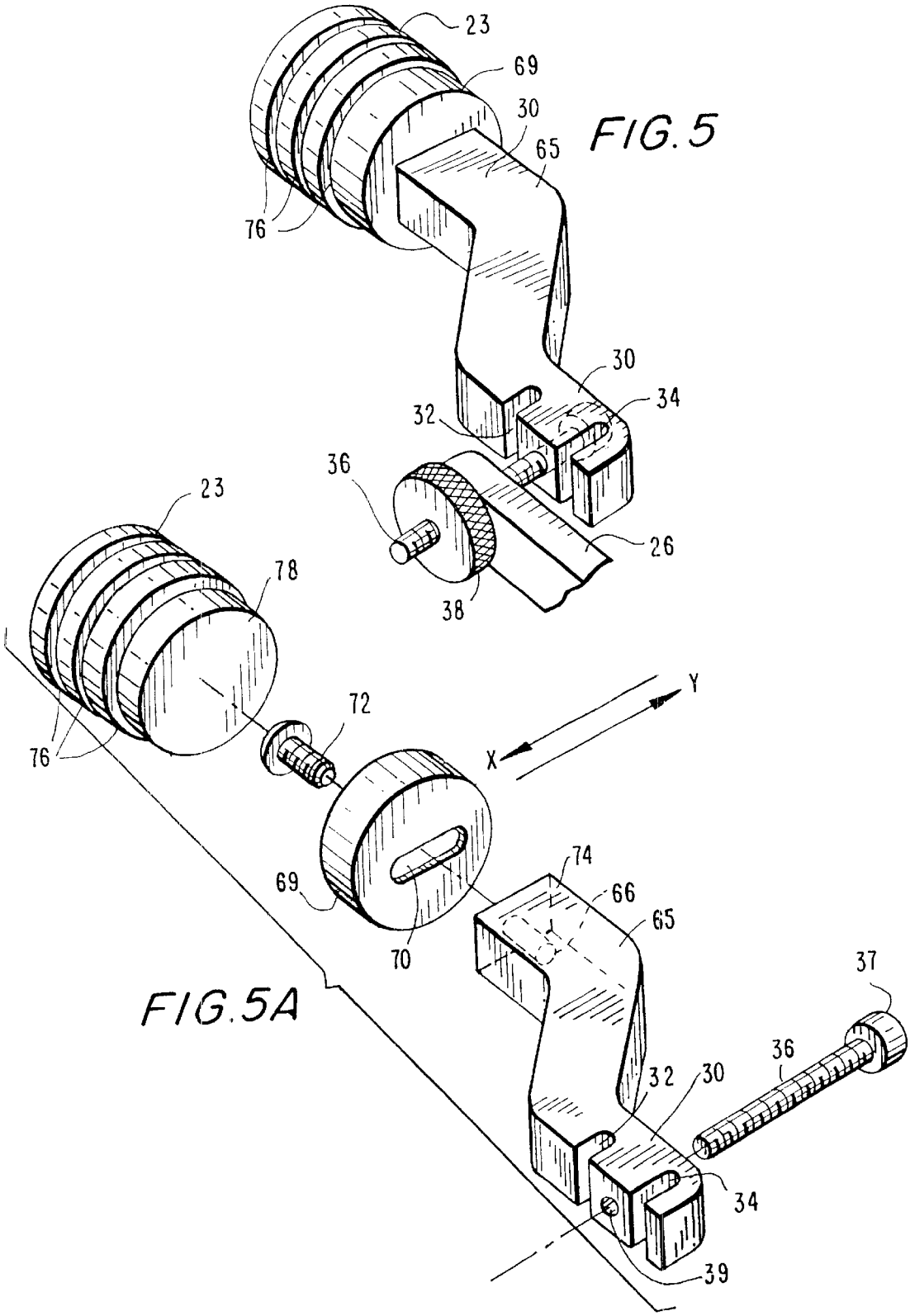
FIG. 5 is a perspective drawing of the vibration dampener and cable saver of the first embodiment of the present invention.
FIG. 5A is an exploded view of the vibration dampener and cable saver of the present invention.

Cable guard assembly 22 includes support arm 24 secured to handle 4. A swing arm 26 is pivotally connected to support arm 24 at pivot end 28. Cable saver 30 is pivotally connected to the other end of swing arm 26 and includes openings 32 and 34, best seen in FIGS. 5 through 5C. Cables 12 and 14 are contained in openings 32 and 34 of cable saver 30. A bow string vibration dampener 23 is attached to cable saver 30 of cable guard assembly 22.

Figure 4:
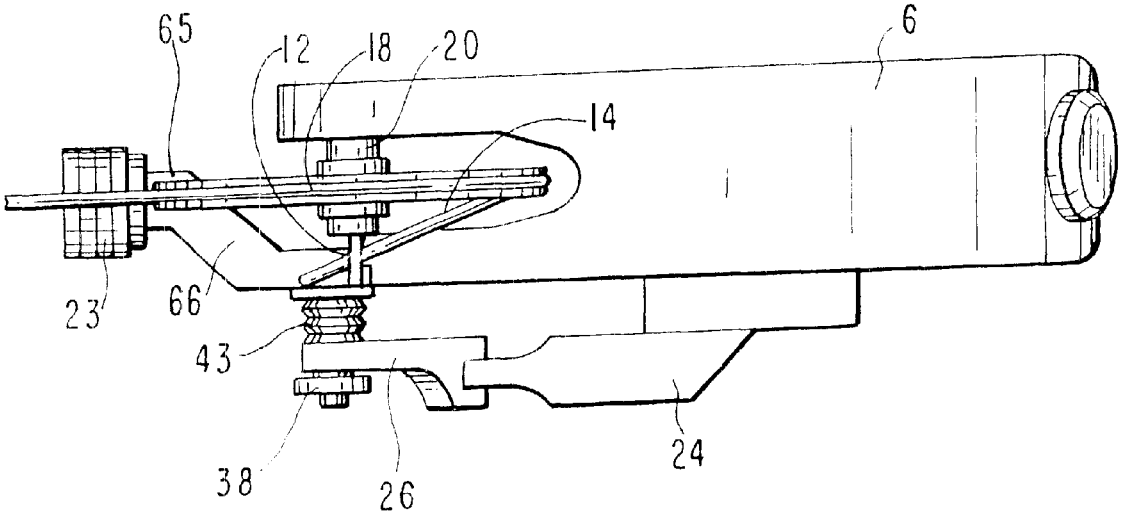
FIG. 4 is a cutaway top plain view of the first embodiment of the present invention wherein the bowstring is in the draw position.

Bowstring vibration dampener 23 which is mounted on the free end of cable saver 30 may be formed of flexible thermoplastic elastomeric material such as sold by GLS Corporation under the trademark "Kraton". It is believed preferable to use an elastomeric material having a durometer in the range of 25 to 35. In the brace position, illustrated in FIGS. 1 and 2, vibration dampener 23, exerts a slight pressure on bowstring 10. Cable saver 30 and vibration dampener 23 are shown in further detail in FIGS. 5 and 5A. Cable saver 30 is a modified version of the cable saver disclosed in U.S. Pat. No. 6,425,385, assigned to the assignee of the present invention and includes an opening 34 which contains cable 12 and an opening 32 which contains cable 14. Cable saver 30 is pivotally connected to the free end of the swing arm 26 by a threaded bolt 36 moveable through an opening 39 in cable saver 30 and a threaded hole 41 in swing arm 26. Threaded bolt 36 has a cap 37 thereon which is of greater diameter than opening 39 in cable saver 30. A thumb wheel 38 on threaded bolt 36 secures the free end of swing arm 26 in position on threaded bolt 36. A compressible bellows 48 is shown in FIGS. 2 and 4 (but omitted from FIGS. 5 to 5C for clarity purposes) covers the threaded bolt 36 to protect cables 12 and 14 from contact with the threads on threaded bolt 36.

Figure 5B:
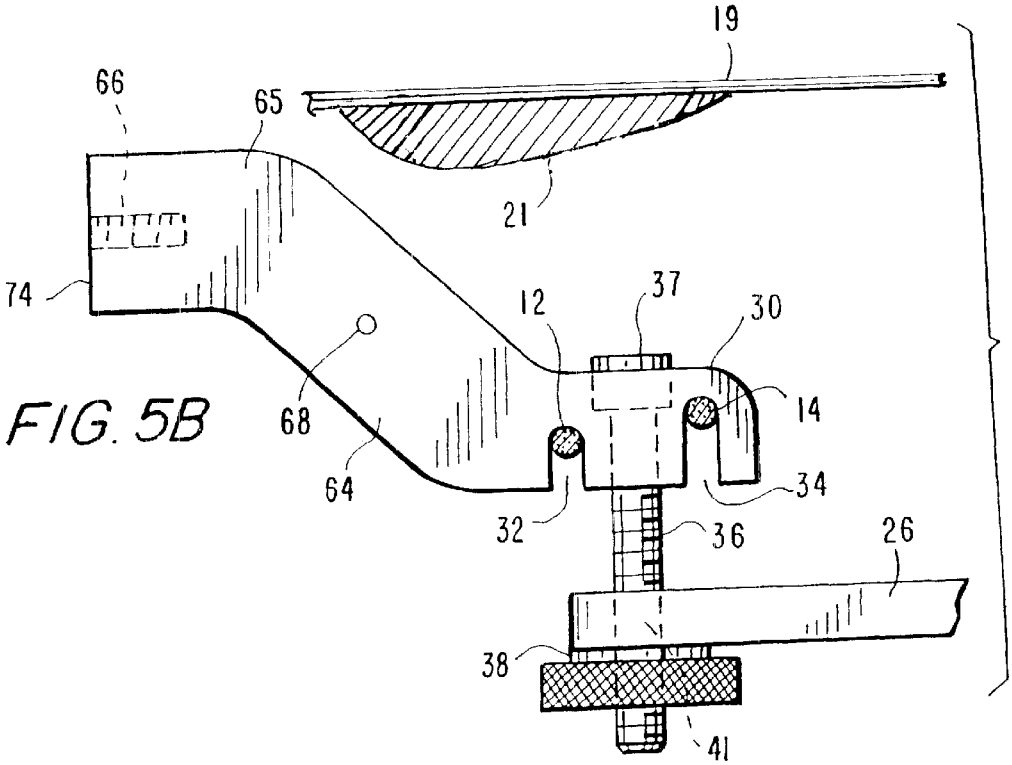
FIG. 5B is a top plan view of the cable saver in which the cable saver is in position to accommodate an arrow flectching of relatively narrow width.
Figure 5C:
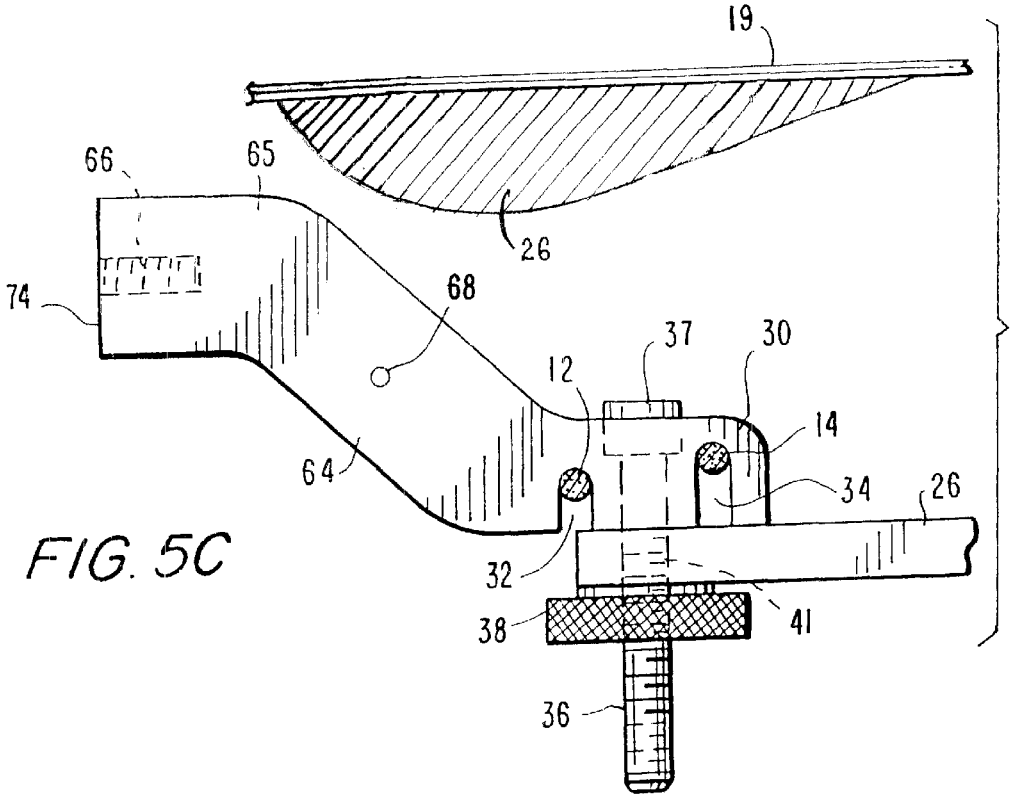
FIG. 5C is a top plan view of the cable saver in which the cable saver is in position to accommodate an arrow fletching of relatively wide width.

As illustrated in FIGS. 5B and 5C, cable saver 30 is adjustable to accommodate different size fletchings, such as fletching 21 of arrow 19 in FIG. 5B which is of smaller width than fletching 25 of arrow 19 in FIG. 5C. It is desirable that the distance between the fletching and cable saver be as small as possible to reduce torque while permitting the fletching to pass therethrough. To achieve the desired distance between the fletching and cable saver 30, threaded bolt 36 is lowered through threaded hole 41 in swing arm 26 until the desired distance is obtained. Then the thumb wheel 38 is rotated on threaded bolt 36 until it contacts the bottom surface of swing arm 26. In this manner, cable saver 30 is maintained at the desired distance from the fletching. FIG. 5B shows the position of the cable saver 30 to accommodate a fletching 21 of smaller width and FIG. 5C shows the position of the cable saver 32 to accommodate a fletching 25 of larger width.

The cable saver 30 has an angular portion 64 and flat portion 65 having an opening 66, with screw threads therein. An opening 68 on the angular portion 64 is for the purpose of reducing weight. A metallic bumper stem 69 which may be formed of aluminium includes a circular lip 69 and a lateral opening 70.

A screw 72 which may have a hexagonal head extends through opening 70 in bumper stem 68 and into threaded opening 66 in the rear surface 74 of the flat portion 65 of cable saver 30. The bow string vibration dampener 23 has a series of circular ridges 76 and a circular end portion 78 of a diameter which permits end portion 78 to be frictionally engaged and maintained in the circular lip 69 of the bumper stem 68. In its normal state, the diameter of circular end portion 78 is of slightly larger diameter than the diameter of a circular lip portion 69. Circular end portion 78 is however, compressible into circular lip 69 for the frictional engagement therewith. The bumper stem 68 may be positioned laterally, in the direction shown by arrows x or y in FIG. 5A, to make certain that vibration dampener 23 carried by bumper stem 68 is in alignment with bowstring 10 when the bow 2 is in the brace position. To position bumper stem 68 laterally, vibration dampener 23 is removed from bumper stem 68 so that screw 72 may be loosened to permit lateral movement of bumper stem 68. Bumper stem 68 is moved to its desired position with respect to cable saver 30 and screw 72 is tightened to connect bumper stem 68 with cable saver 30. The vibration dampener 23 is thereafter reinserted into bumper stem 68.

In this manner, the bumper stem 68 and the vibration dampener 23 inserted therein is adjustable with respect to the cable saver 30 to assure that if the cable saver 30 is adjusted to accommodate different size arrow fletchings such as illustrated in FIGS. 5B and 5C, the vibration dampener 23 can be adjusted to remain in contact with bowstring 10 in the brace position. If, for example, the arrow fletching is of larger width, such as shown in FIG. 5C, and the cable saver 30 is moved in the x direction to accommodate the larger width fletching, then the bumper stem 68 may be moved in the y direction to maintain the vibration dampener 23 in alignment with bowstring 10 in the position.

Figure 3:
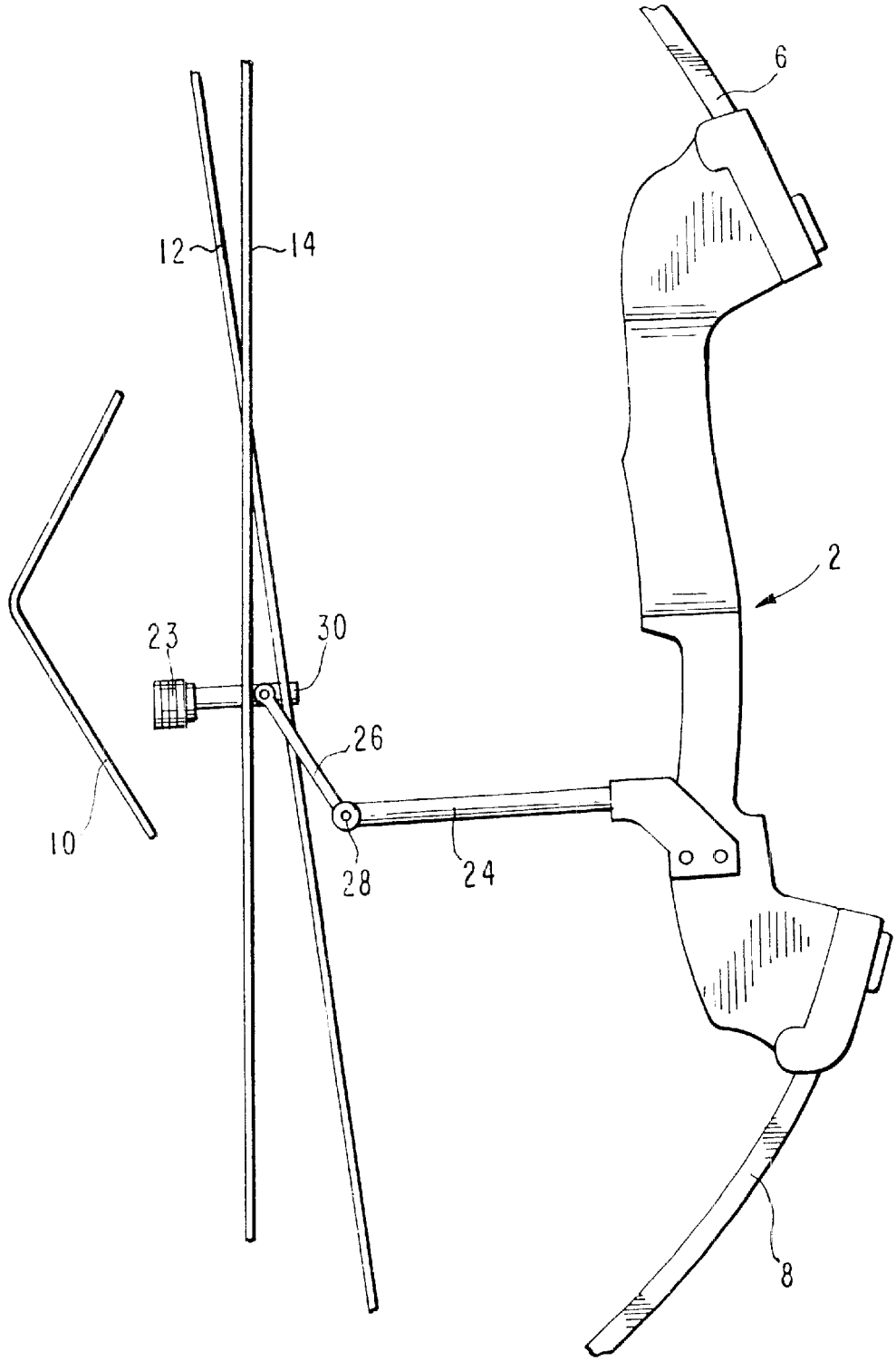
FIG. 3 is a partial right side elevational view of the first embodiment of the present invention wherein the bowstring is in the draw position.

The operation of the first embodiment of the present invention is most readily understood with reference to FIG. 1 in which the bowstring 10 is in the brace position and with reference to FIG. 3, in which the bowstring 10 is in the draw position. It will be seen in FIG. 1 that the vibration dampener 23 abuts the bowstring 10 when bowstring 10 is in the brace position and in this position, vibration dampener 23 exerts a slight pressure on bowstring 10. When bowstring is drawn rearward as shown in FIG. 3, cables 12 and 14 are moved rearward causing swing arm 26 to pivot counterclockwise and cable saver 30 and vibration dampener 23 to travel rearward. It is thus seen that the rearward travel of the vibration dampener 23 is directly controlled by the draw of the bowstring 10.

When bowstring 10 is released and travels forward toward the brace position, the cables 12 and 14 are moved forward causing swing arm 26 to pivot clockwise and cable saver 30 and vibration dampener 23 to travel forward. As the vibration dampener 23 and the bowstring 10 return to their original or brace position, the vibration dampener 23 contacts and cushions the bowstring 10 to dampen the vibration or oscillation of bowstring 10. Both the bowstring 10 and the vibration dampener 23 are in motion when the vibration dampener 23 is in contact and cushions the bowstring 10. The dual motion of the bowstring 10 and the vibration dampener 23 enhances the effectiveness of the vibration dampener 23 to cushion and dampen the vibration of bowstring 10 as it returns to the brace position.

Figure 6:
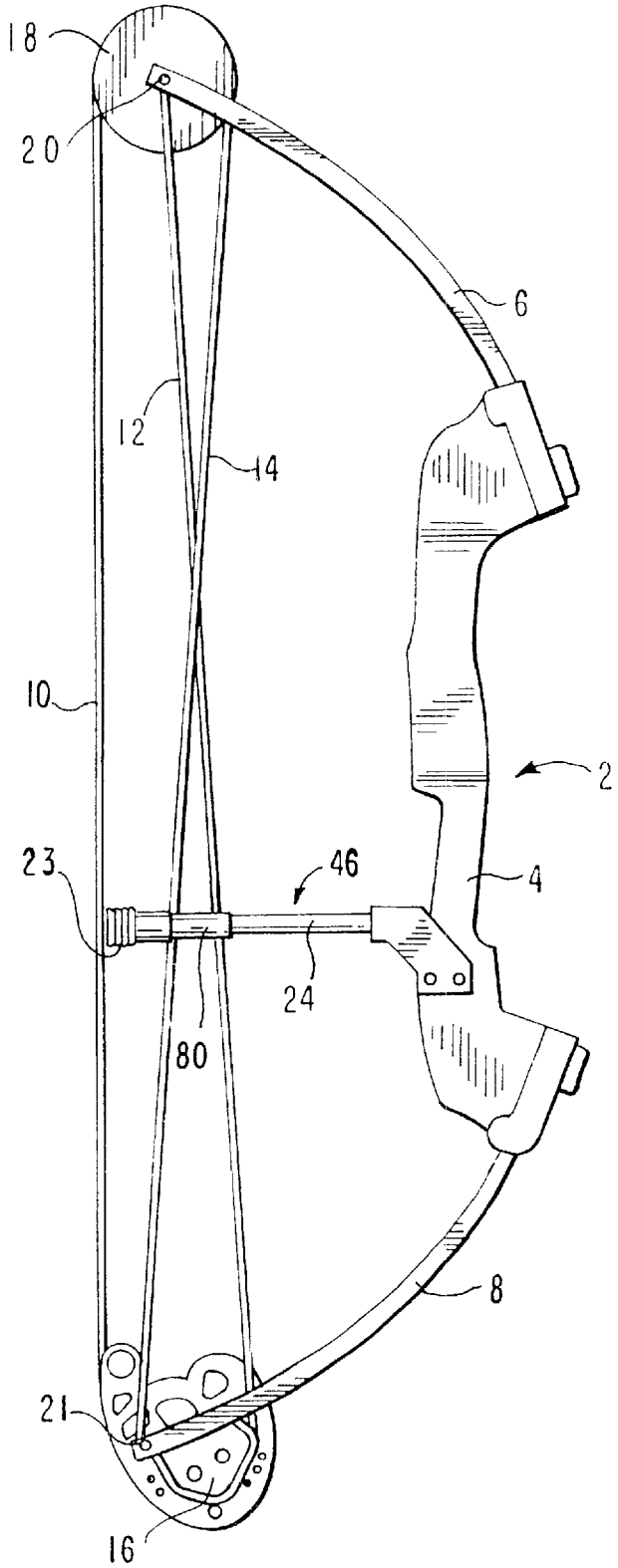
FIG. 6 is a right side elevational view of a compound archery bow which includes a second embodiment of the present invention.
Figure 7:
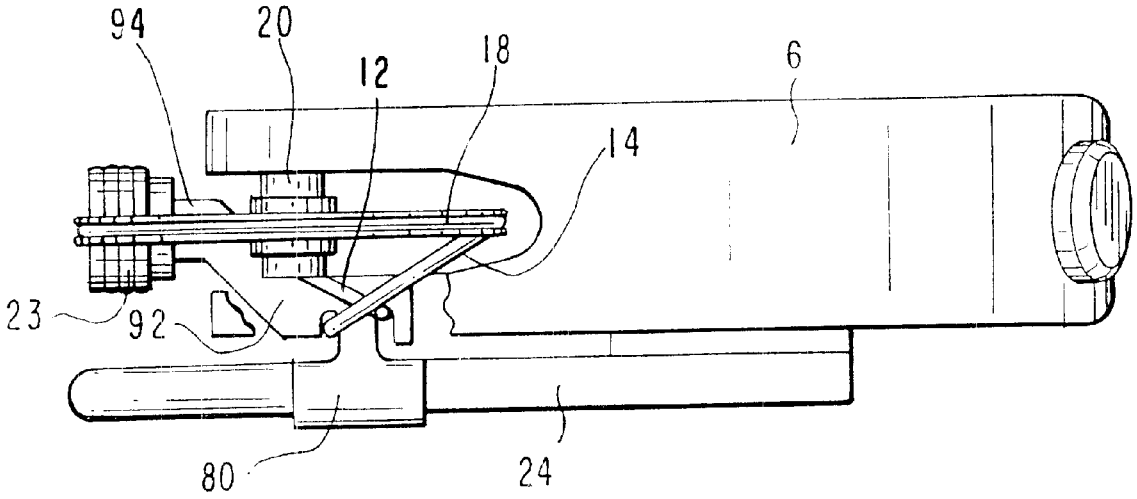
FIG. 7 is a cutaway top plan view of the second embodiment of the present invention wherein the bowstring is in the brace position.
Figure 8:
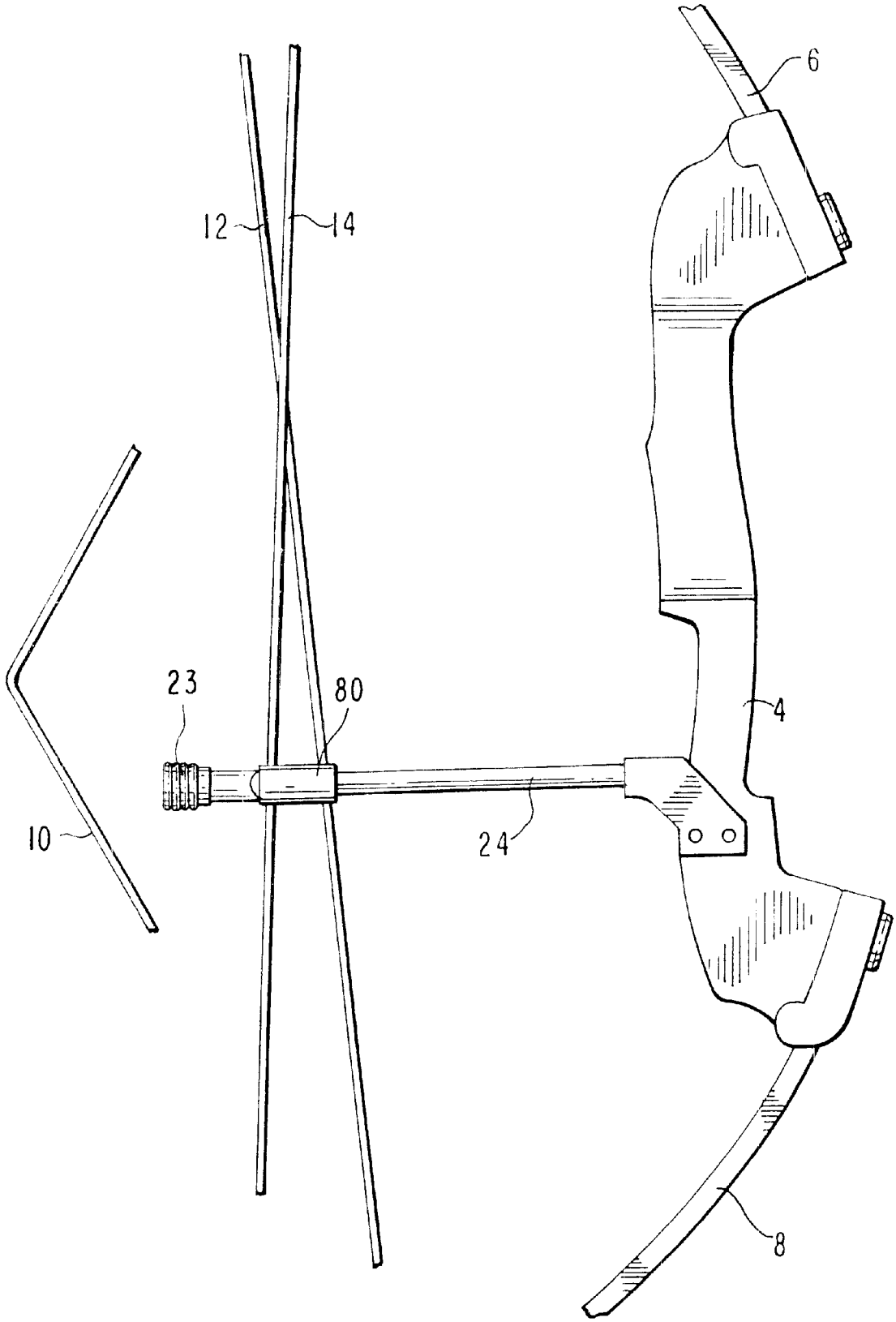
FIG. 8 is a partial right side elevational view of the second embodiment of the present invention wherein the bowstring is in the draw position.
Figure 9:
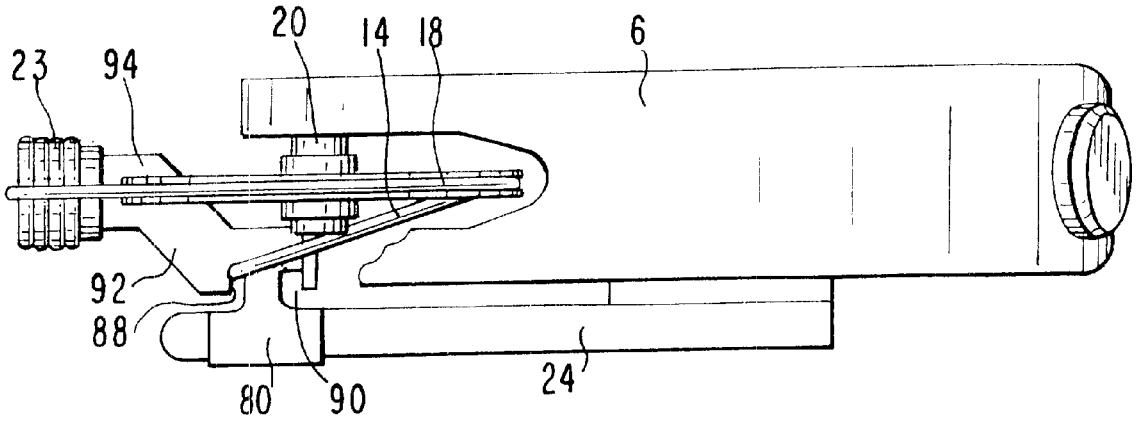
FIG. 9 is a cutaway top plan view of the second embodiment of the present invention wherein the bowstring is in the draw position.

With respect to the second embodiment of the bowstring vibration dampener of the present invention, there is shown in FIG. 6 a compound bow 2, similar to the compound bow of FIG. 1, with the exception of the cable guard assembly 46. Cable guard assembly 46 includes support arm 24 secured to handle 4 and a cable saver 80 which is slideably mounted on support arm 24. Previously described vibration dampener 23 is connected to the cable saver 80 which is slideably mounted on the free end of support arm 24. Vibration dampener 23 is connected to the cable saver 80 in the same manner, described above, that vibration dampener 23 is connected to cable saver 30. In the brace position, illustrated in FIG. 6, vibration dampener 23, exerts a slight pressure on bowstring 10. FIG. 8 shows the position of the cable guard assembly 46, including cable saver 50, cables 12 and 14, and vibration dampener 23 when the bowstring is in the draw position.

Figure 10:
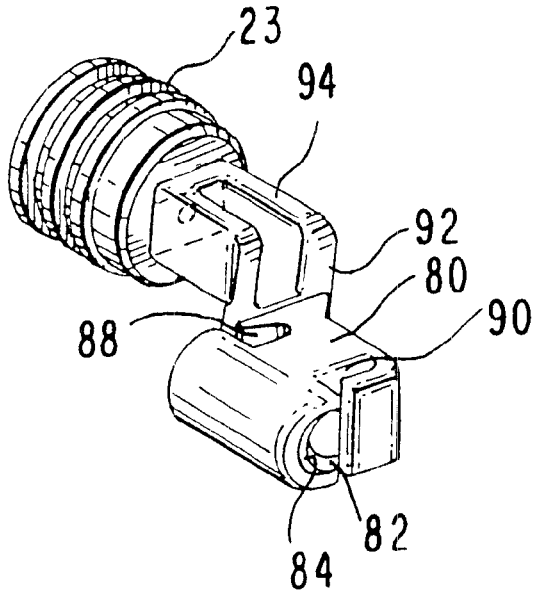
FIG. 10 is a perspective drawing of the vibration dampener and cable saver of the second embodiment of the present invention.
Figure 10A:
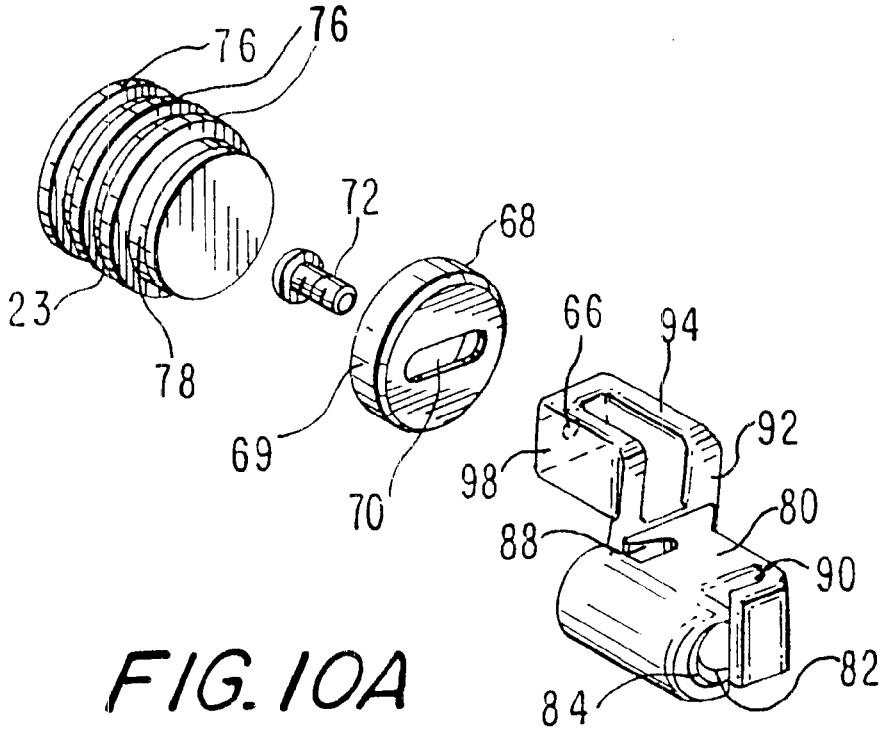
FIG. 10A is a perspective drawing of the vibration dampener and cable saver of the second embodiment of the present invention.

Cable saver 80 and vibration dampener 23 are shown in further detail in FIGS. 10 and 10A. It will be seen that cable saver 80 has an opening 82 which telescopes over support arm 24 for sliding movement thereon. Opening 82 in cable saver 80 includes a partial circular section 84. Cable saver 80 is spaced from support arm 24 a sufficient distance to permit cable 14 to be inserted therebetween and into opening 88 in cable saver 80 and also to permit cable 12 to be inserted therebetween and into opening 90 in cable saver 80. Cable saver 80 includes an angular portion 92 and a flat portion 94 having a rear portion 98. In all other respects, the vibration dampener 23, and the manner in which it is engaged and maintained in the circular lip 69 of bumper stem 68, and the screw 72, and the manner it secures the bumper stem 68 to the cable saver 80, is the same as in the first embodiment shown in FIGS. 1 to 5.

The operation of the second embodiment of the present invention is most readily understood with reference to FIG. 6 in which the bowstring 10 is in the brace position and with reference to FIG. 8 in which the bowstring 10 is in the draw position. As shown in FIG. 6, the vibration dampener 23 abuts the bowstring 10 to exert slight pressure thereon when the bowstring 10 is in the brace position. When bowstring 10 is drawn rearward as shown in FIG. 8, cables 12 and 14 are moved rearward causing cable saver 80 and vibration dampener 3 to travel rearward. Here, again, rearward travel of vibration dampener 23 is directly controlled by the draw of the bowstring 10.

When bowstring 10 is released and travels forward toward the brace position, the cables 12 and 14 are moved forward causing cable saver 80 and vibration dampener 23 to travel forward. As the vibration dampener 23 and the bowstring 10 return to their original or brace position, the vibration dampener 23 contacts and cushions the bowstring 10 to dampen the vibration or oscillation of bowstring 10. As with respect to the first embodiment, both the bowstring 10 and the vibration dampener 23 are in motion when the vibration dampener 23 is in contact and cushions bowstring 10. The dual motion of the vibration dampener 23 and bowstring 10 enhances the effectiveness of the vibration dampener 23 to cushion and dampen the vibration or oscillation of bowstring 10 as bowstring 10 returns to the brace position.

This invention has been described above with reference to presently preferred embodiments of the invention; such description has not been presented as a catalog exhaustive of all forms this invention may take. Accordingly, workers skilled in the art to which this invention pertains will readily appreciate that variations, alterations or modification in the structures, procedures, and arrangements described above may be practiced without departing from the scope of he invention. Thus, the foregoing description should not be read as limiting the scope of this invention to less that the fair scope of the following claims:

What is claimed as novel and desired to be secured as Letters Patent is:

1. A compound archery bow comprising a handle, at least one eccentric cam, a bowstring and cables, a cable saver for separating the bowstring and the cables to permit an arrow to pass therethrough, and a traveling vibration dampener for dampening bowstring oscillation and wherein said vibration dampener is mounted on said cable saver for movement therewith.

2. A compound bow as recited in claim 1 wherein the cables are contained within openings in the cable saver.

3. A compound bow as recited in claim 1 wherein the vibration dampener is formed of elastomeric material.

4. A compound bow as recited in claim 3 wherein the vibration dampener is formed of elastomeric material having a durometer in the range of 25 to 35.

5. A compound bow as recited in claim 1 wherein the movement of the vibration dampener is controlled by the draw and release of the bowstring.

6. A compound bow as recited in claim 1 including limbs attached to the handle.

7. A compound bow as recited in claim 6 having at least one eccentric cam attached to one of said limbs.

8. A compound bow as recited in claim 1 having means for adjusting the vibration dampener with respect to the cable saver.

9. A compound archery bow as recited in claim 1, wherein said cable saver is pivotally connected to a swing arm and wherein said swing arm is pivotally connected to a support arm on said bow.

10. A compound bow as recited in claim 9 wherein the cables are contained within openings in the cable saver.

11. A compound bow as recited in claim 10 including limbs attached to the handle.

12. A compound bow as recited in claim 11 having at least one eccentric cam attached to one of said limbs.

13. A compound bow as recited in claim 12 wherein the cables are contained within openings in the cable saver.

14. A compound bow as recited in claim 10 having means for adjusting the vibration dampener with respect to the cable saver.

15. A compound bow as recited in claim 9 wherein the vibration dampener is formed of elastomeric material.

16. A compound bow as recited in claim 9 wherein the vibration dampener is formed of elastomeric material having a durometer in the range of 25 to 35.

17. A compound bow as recited in claim 9 wherein the movement of the vibration dampener is controlled by the draw and release of the bowstring.

18. A compound bow as recited in claim 1 wherein the cable saver is slideable on a support arm on said bow.

19. A compound bow as recited in claim 18 wherein the vibration dampener is formed of elastomeric material.

20. A compound bow as recited in claim 18 wherein the vibration dampener is formed of elastomeric material having a duromter in the range of 20 to 35.

21. A compound bow as recited in claim 18 wherein the movement of the vibration dampener is controlled by the draw and release of the bowstring.

22. A compound bow as recited in claim 18 including limbs attached to the handle.

23. A compound bow as recited in claim 22 having at least one eccentric can attached to one of the said limbs.

24. A compound bow as recited in claim 18 having means for adjusting the vibration dampener with respect to the cable saver.

* * * * *